US008352254B2

(12) United States Patent
Ehara

(10) Patent No.: US 8,352,254 B2
(45) Date of Patent: Jan. 8, 2013

(54) FIXED CODE BOOK SEARCH DEVICE AND FIXED CODE BOOK SEARCH METHOD

(75) Inventor: Hiroyuki Ehara, Kanagawa (JP)

(73) Assignee: Panasonic Corporation, Osaka (JP)

( * ) Notice: Subject to any disclaimer, the term of this patent is extended or adjusted under 35 U.S.C. 154(b) by 1251 days.

(21) Appl. No.: 12/096,424

(22) PCT Filed: Dec. 8, 2006

(86) PCT No.: PCT/JP2006/324587

§ 371 (c)(1),
(2), (4) Date: Jun. 6, 2008

(87) PCT Pub. No.: WO2007/066771

PCT Pub. Date: Jun. 14, 2007

(65) Prior Publication Data

US 2009/0292534 A1 Nov. 26, 2009

(30) Foreign Application Priority Data

Dec. 9, 2005 (JP) ..... 2005-356634

(51) Int. Cl.
*G10L 19/12* (2006.01)
*G10L 19/00* (2006.01)

(52) U.S. Cl. ..... 704/223; 704/219; 704/221

(58) Field of Classification Search ..... 704/219, 704/222

See application file for complete search history.

(56) References Cited

U.S. PATENT DOCUMENTS 4,963,034 A * 10/1990 Cuperman et al. ..... 704/222
5,265,190 A * 11/1993 Yip et al. ..... 704/219
5,371,853 A * 12/1994 Kao et al. ..... 704/200.1
5,396,576 A * 3/1995 Miki et al. ..... 704/222
5,444,816 A 8/1995 Adoul et al.
5,602,959 A * 2/1997 Bergstrom et al. ..... 704/205
5,699,482 A 12/1997 Adoul et al.
5,701,392 A 12/1997 Adoul et al.

(Continued)

FOREIGN PATENT DOCUMENTS

JP 10-63300 3/1989

(Continued)

OTHER PUBLICATIONS

Ahmed, M.E.; Al-Suwaiyel, M.I.; , "Fast methods for code search in CELP," Speech and Audio Processing, IEEE Transactions on , vol. 1, No. 3, pp. 315-325, Jul. 1993 doi: 10.1109/89.232615 URL: http://ieeexplore.ieee.org/stamp/stamp.jsp?tp=&arnumber=232615&isnumber=9016.*

Salami, R.; Laflamme, C.; Adoul, J.-P.; Kataoka, A.; Hayashi, S.; Moriya, T.; Lamblin, C.; Massaloux, D.; Proust, S.; Kroon, P.; Shaham, Y.; , "Design and description of CS-ACELP: a toll quality 8 kb/s speech coder," Speech and Audio Processing, IEEE Transactions on , vol. 6, No. 2, pp. 116-130, Mar. 1998,doi: 10.1109/89.661471.*

(Continued)

*Primary Examiner* — Pierre-Louis Desir
*Assistant Examiner* — Matthew Baker
(74) *Attorney, Agent, or Firm* — Greenblum & Bernstein, P.L.C.

(57) ABSTRACT

A fixed code book (FCB) search device simplifies an error minimizing process and reduces a calculation amount so as to prevent deterioration of a coding performance. The FCB search device includes a pulse shape convolution inverse filter having an inverse feature of a pulse diffusion filter and supplied with an ideal residual signal; a pulse candidate preparatory selector that pre-selects a plurality of pulse candidates from the ideal residual signal to which the inverse filter is applied; and a pulse candidate final selector that finally selects one pulse from the selected candidates. Using this configuration, a search is made for an algebra code book to which the pulse diffusion is applied.

7 Claims, 5 Drawing Sheets

U.S. PATENT DOCUMENTS

| | | | | |
|---|---|---|---|---|
| 5,754,976 | A | 5/1998 | Adoul et al. | |
| 6,012,024 | A * | 1/2000 | Hofmann | 704/219 |
| 6,055,496 | A * | 4/2000 | Heidari et al. | 704/222 |
| 6,330,534 | B1 * | 12/2001 | Yasunaga et al. | 704/223 |
| 6,330,535 | B1 * | 12/2001 | Yasunaga et al. | 704/223 |
| 6,334,105 | B1 * | 12/2001 | Ehara | 704/258 |
| 6,345,247 | B1 * | 2/2002 | Yasunaga et al. | 704/219 |
| 6,917,914 | B2 * | 7/2005 | Chamberlain | 704/219 |
| 6,988,065 | B1 | 1/2006 | Yasunaga et al. | |
| 7,580,834 | B2 * | 8/2009 | Ehara et al. | 704/221 |
| 2001/0023396 | A1 * | 9/2001 | Gersho et al. | 704/220 |
| 2004/0153317 | A1 * | 8/2004 | Chamberlain | 704/219 |
| 2005/0075869 | A1 * | 4/2005 | Gersho et al. | 704/223 |
| 2006/0020450 | A1 | 1/2006 | Miseki | |
| 2007/0213977 | A1 | 9/2007 | Ehara et al. | |
| 2007/0271092 | A1 | 11/2007 | Ehara et al. | |
| 2007/0299669 | A1 | 12/2007 | Ehara | |
| 2008/0052066 | A1 | 2/2008 | Oshikiri et al. | |
| 2008/0126082 | A1 | 5/2008 | Ehara et al. | |

FOREIGN PATENT DOCUMENTS

| | | |
|---|---|---|
| JP | 10-513571 | 12/1998 |
| JP | 2001-27900 | 1/2001 |
| JP | 2001-134298 | 5/2001 |
| JP | 2004-126628 | 4/2004 |
| JP | 2004-309686 | 11/2004 |

OTHER PUBLICATIONS

Yue Li; Kun Tang; Huijuan Cui; , "A high quality 4 kb/s multiple pulse-dispersion ACELP speech coder," Communications, Circuits and Systems, 2004. ICCCAS 2004. 2004 International Conference on , vol. 2, No., pp. 923-912 vol. 2, Jun. 27-29, 2004.*

McCree, A.V.; Barnwell, T.P., III; , "A mixed excitation LPC vocoder model for low bit rate speech coding ," Speech and Audio Processing, IEEE Transactions on , vol. 3, No. 4, pp. 242-250, Jul. 1995.*

Adoul, J.-P.; Mabilleau, P.; Delprat, M.; Morissette, S.;, "Fast CELP coding based on algebraic codes," Acoustics, Speech, and Signal Processing, IEEE International Conference on ICASSP '87. , vol. 12, No., pp. 1957-1960, Apr. 1987.*

Yasunaga, K.; Ehara, H.; Yoshida, K.; Morii, T.; , "Dispersed-pulse codebook and its application to a 4 kb/s speech coder," Acoustics, Speech, and Signal Processing, 2000. ICASSP '00. Proceedings. 2000 IEEE International Conference on , vol. 3, No., pp. 1503-1506 vol. 3, 2000.*

English language Abstract of JP 10-63300, Mar. 9, 1989.

Yasunaga et al., "Pulse Kakusan Ongen o Mochiita Tei-rate Onsei Fugoka", The Acoustical Society of Japan (ASJ) Heisei 10 Nendo Shuki Kenkyu Happyokai Koen Ronbunshu-I-, Sep. 24, 1998, pp. 281-282.

* cited by examiner

FIXED CODE BOOK SEARCH DEVICE AND FIXED CODE BOOK SEARCH METHOD

TECHNICAL FIELD

The present invention relates to a fixed codebook search apparatus and fixed codebook search method using pulse excitation.

BACKGROUND ART

An algebraic codebook, which algebraically arranges a small number of pulses to form a fixed codebook vector, does not require a memory for a codebook and makes it possible to reduce the amount of computation by codebook search in a relatively easy manner, and, consequently, is adopted for various standard codec including G.729 in ITU-T for speech coding.

However, an algebraic codebook merely arranges a small number of pulses algebraically, and, consequently, there is a limit to the vector characteristics that can be expressed by the algebraic codebook. As a result, the algebraic codebook does not always yield sufficient coding quality. Here, as a technique of improving an algebraic codebook, there is a technique referred to as "pulse dispersion" (e.g., see Patent Document 1). By convoluting pulses with a specific shape of dispersion vectors, this technique makes it possible to generate vectors having characteristics that are difficult to be expressed by a sparse pulse vector generated in an algebraic codebook.

Here, the amount of computation in an algebraic codebook search increases when the number of pulses to be used increases. Consequently, ingenuity is required to reduce the amount of computation especially when an algebraic codebook with a large number of pulses is used. For example, when the number of pulses increases like ten pulses, the number of combinations is enormous, and, consequently, it is not practical to perform exhaust codebook search. To reduce the amount of computation in this algebraic codebook with a large number of pulses, there is a technique of limiting the range of codebook search by combining an evaluation function that minimizes errors in the synthesized signal and an evaluation function that minimizes errors in the linear prediction residual signal (e.g., see Patent Document 2).

According to this technique, upon a general algebraic codebook search, to minimize errors in the synthesized signal, evaluation function Es expressed by following equation 1 is maximized.

(Equation 1)

$$E_s = \frac{(x^t Hc)^2}{c^t H^t Hc} \quad [1]$$

Here, "x" is the target vector, "H" is the lower triangular matrix expressing impulse response convolution in an auditory weighting synthesis filter, "c" is the sparse pulse vector generated by an algebraic codebook, and subscript "t" shows that the matrix (or vector) is a transposed matrix (or transposed vector). For example, G.729 in ITU-T performs a codebook search based on the above-noted evaluation equation.

Patent Document 1: Japanese Patent Application Laid-Open No. Hei 10-63300

Patent Document 2: Published Japanese Translations of PCT International Publication for patent applications Laid-Open No. Hei 10-513571

DISCLOSURE OF INVENTION

Problems to be Solved by the Invention

In above equation 1, in "c," elements alone have values in only positions where a pulse occurs and have the absolute value of one unless pulses overlap. Consequently, for example, when the number of pulses is three, the numerator term and denominator term of Es are expressed by following equations 2 and 3, respectively.

$$\text{The numerator term of } Es = S1*Dn[i1]+S2*Dn[i2]+S3*Dn[i3] \quad \text{(Equation 2)}$$

$$\text{The denominator term of } Es = \phi[i1][i1]+\phi[i2][i2]+\phi[i3][i3]+2(S1*S2*([i1][i2]+S1*S3*\phi[i1][i3]+S2*S3*[i2][i3]) \quad \text{(Equation 3)}$$

Here, vector Dn is $x^tH$ in equation 1 and matrix $\phi$ is $H^tH$ in equation 1. Further, "Sn" is the polarity of the n-th pulse (in particular, positive and negative) and "in" is the position of the n-th pulse.

That is, by calculating vector Dn and matrix $\phi$ in advance, extracting elements of Dn and $\phi$ required according to the position where a pulse occurs and summing up these elements, it is possible to calculate the numerator term and denominator term of Es. Thus, a feature of an algebraic codebook is to perform a calculation of error evaluation function easily.

On the other hand, the evaluation function that minimizes errors in the linear prediction residual signal, that is, evaluation function Er that minimizes errors in the residual domain, is assumed to be expressed by following equation 4.

(Equation 4)

$$E_r = \frac{(r^t c)^2}{c^t c} \quad [2]$$

Here, "r" is the linear prediction residual vector (ideal residual vector) of an input signal. Maximizing this "Er" leads to minimizing errors in the residual domain.

This error minimization in the residual domain does not involve a synthesis filter, and, consequently, removes the parts of impulse response convolution matrix H in the filter from above equation 1. In this equation, "c" is the sparce pulse vector with a predetermined number of pulses, and, consequently, the denominator term of this equation is a constant regardless of combinations of pulse positions (this is on the condition that the positions of different pulses do not overlap). Therefore, maximization of the numerator term of Er leads to the maximization of Er.

Here, for the numerator term, elements in positions where pulses occur are merely extracted from an ideal residual vector and summed up. Consequently, the combinations of pulses need not be taken into consideration and the positions where the amplitude of ideal residue is maximum should be selected from candidates of positions where pulses occur. That is, without taking into consideration the combinations of pulses, error minimization in the residual domain can yield the same result as the result yielded by trying all combinations of pulses. Although minimizing errors in the residual domain is not equivalent to minimizing errors in a synthesized signal, if the denominator term of Es has significant influence on a value of evaluation function Es, it is possible to yield a more appropriate result compared with a method of ignoring the denominator term and approximating error minimization in the synthesis domain using only the numerator term.

Therefore, the vector combining two vectors "Dn" and "r" is used for a preliminary selection for pulse positions. Here, the preliminary selection means limiting the range of pulse positions roughly in advance. Further, after the preliminary selection, the pulse positions are determined by second high-accurate selection in this range. However, "Dn" and "r" are totally different in magnitude, and, consequently, need to be combined after processing such as normalizing "Dn" and "r" using energy of these vectors. By performing a preliminary selection for the combination of pulse positions that maximizes this combined vector, or by determining a pulse in a position where the element of the combined vector is large, and searching the rest of the pulse positions, it is possible to reduce the amount of computation for pulse search.

However, if the above pulse dispersion technique is adapted to the technique disclosed in Patent Document 2, the following problem will occur.

Following equation 5 shows an example of evaluation function Er that can be used in the above case (Equation 5)

$$E_r = \frac{(r^t Dc)^2}{c^t D^t Dc} \quad [3]$$

Here, "D" is a matrix to which dispersion vectors are convoluted.

In this case, even in the residual domain, a pulse vector passes through a dispersion filter, and, consequently, the denominator term of the evaluation function for error minimization changes according to the combinations of pulse positions. As a result, error minimization processing cannot be simplified. That is, without taking into consideration the influence of processing of convoluting pulses with dispersion vectors, there is a possibility that the degradation of coding performance due to the reduction of the amount of computation becomes larger than the degradation of coding performance in the case of a general algebraic codebook which does not use the pulse dispersion technique.

It is therefore an object of the present invention to provide a fixed codebook search apparatus and fixed codebook search method that prevent degradation of coding performance by simplifying error minimization processing and reducing the amount of computation, when the above pulse dispersion technique is applied to the technique disclosed in Patent Document 2.

Means for Solving the Problem

The fixed codebook search method of the present invention for searching a fixed codebook that generates a fixed codebook vector by convoluting a shape vector with a pulse, includes the steps of: filtering a linear prediction residual signal using a filter having inverse characteristic of a filter for convoluting the shape vector; limiting pulse position candidates in a pulse vector using a first evaluation function that minimizes error between a signal, which is acquired by filtering using the filter having the inverse characteristic, and the pulse vector; and searching the fixed codebook using the limited pulse position candidates and a second evaluation function.

Advantageous Effect of the Invention

With the present invention, by simplifying error minimization processing and reducing the amount of computation, it is possible to prevent degradation of coding performance upon performing a fast fixed codebook search.

BEST MODE FOR CARRYING OUT THE INVENTION

Embodiments of the present invention will be explained below in detail with reference to the accompanying drawings.

Embodiment 1

Figure 1:
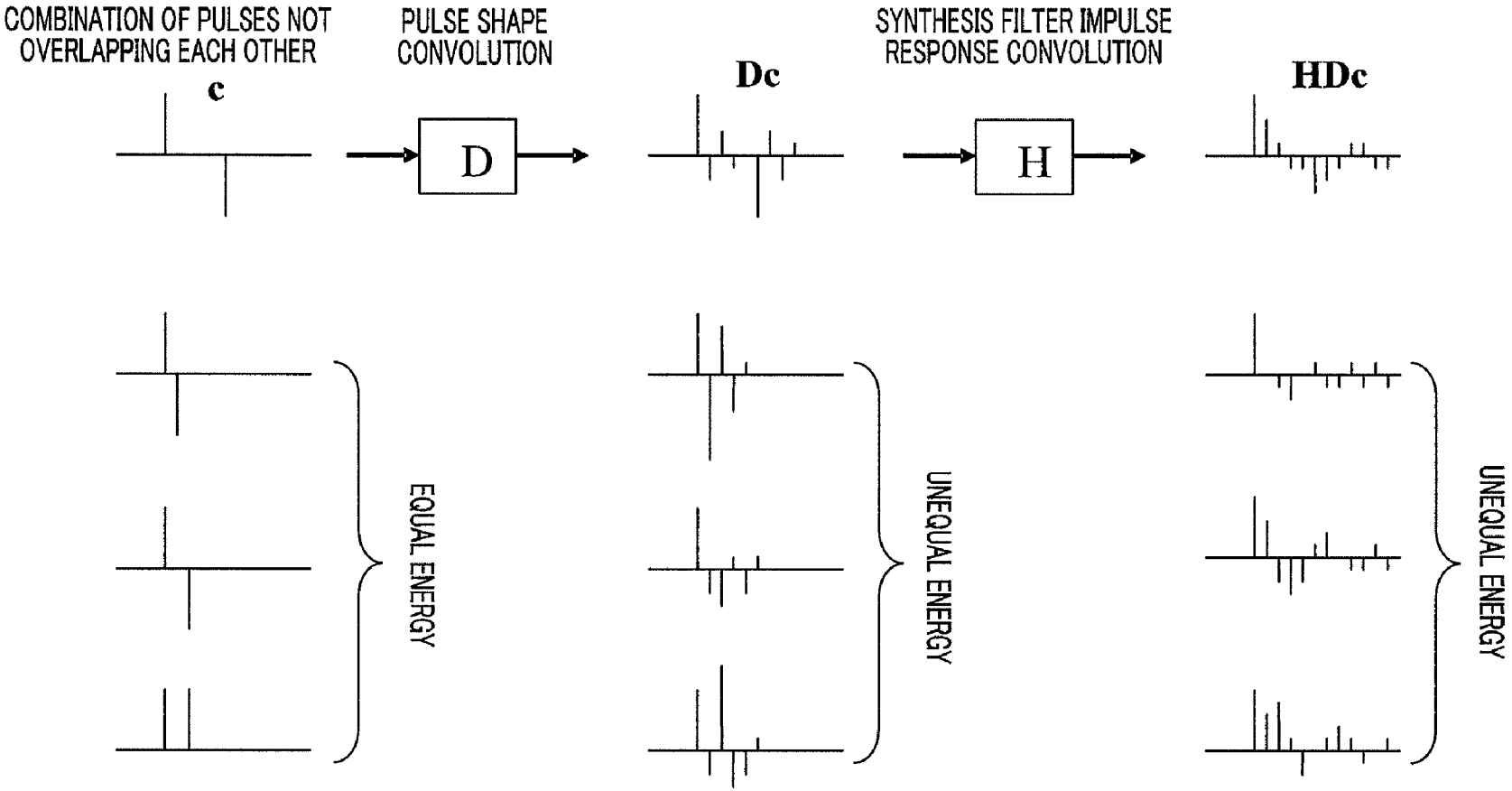
FIG. 1 illustrates a process of a signal from the state of pulse excitation to a generated synthesized signal.

FIG. 1 illustrates a process of a signal from the state of pulse excitation to a generated synthesized signal in CELP coding upon convoluting a pulse shape, that is, upon processing passing a pulse through a dispersion filter. "c" is a sparse pulse vector generated by an algebraic codebook, "D" is a matrix to which a dispersion vector is convoluted, and "H" is the lower triangular matrix representing convolution of an impulse response of a perceptually weighted synthesis filter.

In this figure, "c" is comprised of pulses not overlapping each other, and, consequently, once the number of pulses is determined, the energy of the pulse vector has a fixed value. By contrast, in "Dc" and "HDc," there are parts where components generated from one pulse overlap each other, and, consequently, the energy of the vectors changes according to the correlation between these overlapped parts. Therefore, when we consider the error minimization between "c," "Dc" and "HDc" and their target vectors, "c" does not need to be normalized by its energy, in the case of "Dc" and "HDc," however, "Dc" and "HDc" need to be normalized by their energies for taking into consideration the difference of the energies between the vectors.

Figure 2:
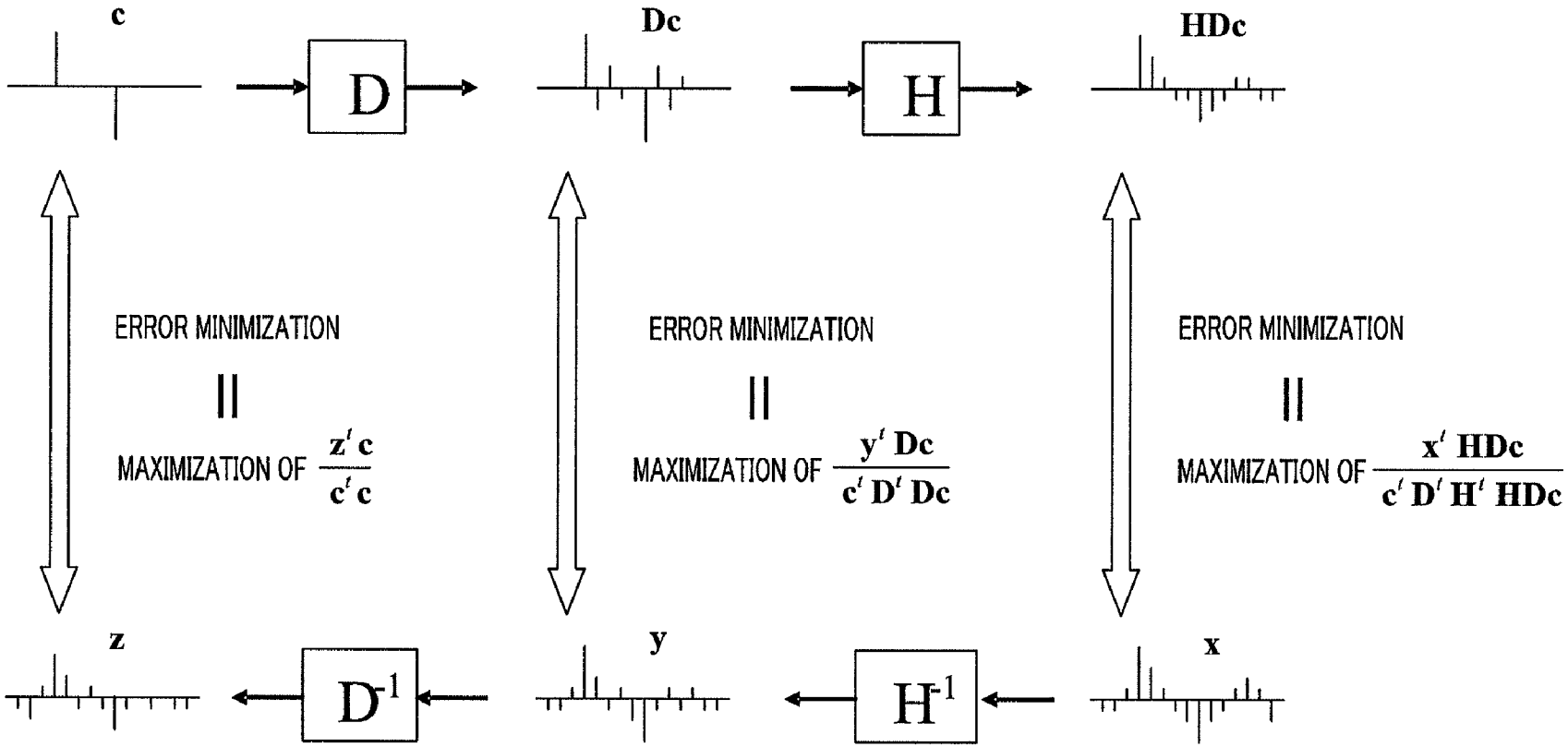
FIG. 2 illustrates equations for evaluation functions and a difference of the evaluation functions using the parameter in each stage.

FIG. 2 illustrates equations for evaluation functions and differences of the evaluation functions using the parameter in each stage. "x," "y" and "z" shown in the lower part of the figure are the target vectors for "HDc," "Dc" and "c" shown in the upper part of the figure, respectively. That is, if they have no differences from these target vectors, coding distortion becomes zero.

Generally, "x" is a vector yielded by passing an input speech signal through a perceptually weighting filter. However, in an enhancement layer for scalable coding, it is a vector acquired by transforming a residual signal to be encoded in this layer into the perceptually weighted domain. To be more specific, as shown in FIG. 1, "x" is a vector acquired by passing an ideal residual signal, like a residual signal acquired by linear prediction, through a perceptually weighted synthesis filter. Pulse shape convolution inverse filter $D^{-1}$ and synthesis filter impulse response convolution inverse filter $H^{-1}$ are designed such that "z" becomes "y" through pulse shape convolution filter D and "y" becomes "x" by convoluting "y" with synthesis filter impulse response.

Here, it is also possible to set "y" as an ideal residual signal and acquire "x" by passing "y" through the synthesis filter impulse response convolution filter.

For example, for CELP coding, minimization of coding errors are not performed in the residual domain, but coding errors in a synthesized signal are minimized. That is, minimization of the error between "HDc" and "x" is performed. As shown in FIG. 2, this minimization is equivalent to the maximization of the evaluation function shown in following equation 6.

$$\text{Evaluation function}=x^tHDc/c^tD^tH^tHDc \quad \text{(Equation 6)}$$

Here, "t" denotes the transposition of the matrix.

That is, equation 6 expresses the maximization of normalization of the cross-correlation between "x" and "HDc" using the energy of "HDc." As described above, if vector "$x^tHD$" is calculated in advance, it is possible to maximize the numerator of this equation fast. In particular, in an algebraic codebook where positions of pulses do not overlap, the position where element of vector "$x^tHD$" is maximum should be selected on a per pulse basis from candidates of positions where pulses occur. Consequently, when the number of the position candidates of each pulse is the same, it is possible to maximize the numerator term by (the number of pulses×the number of pulse position candidates) times of comparisons. On the other hand, there are correlation terms between pulses in the denominator term, and, consequently, maximization processing cannot be performed on each pulse individually, and all combinations of pulses need to be taken into consideration. This problem similarly occurs for the minimization of the error between "Dc" and "y." However, for the minimization of the error between "c" and "z," denominator term "$c^tc$" is a constant, so that it is possible to perform maximization processing by only the numerator term.

Therefore, by reducing the number of the pulse position candidates by the minimization of the error between "c" and "z", and the final pulse vector is determined by performing the minimization of the error between "x" and "HDc" using only on the reduced number of pulse position candidates. In this reducing process, the numerator term ($x^tHDc$) for use upon the final minimization of the error between "x" and "HDc" is also used.

Figure 3:
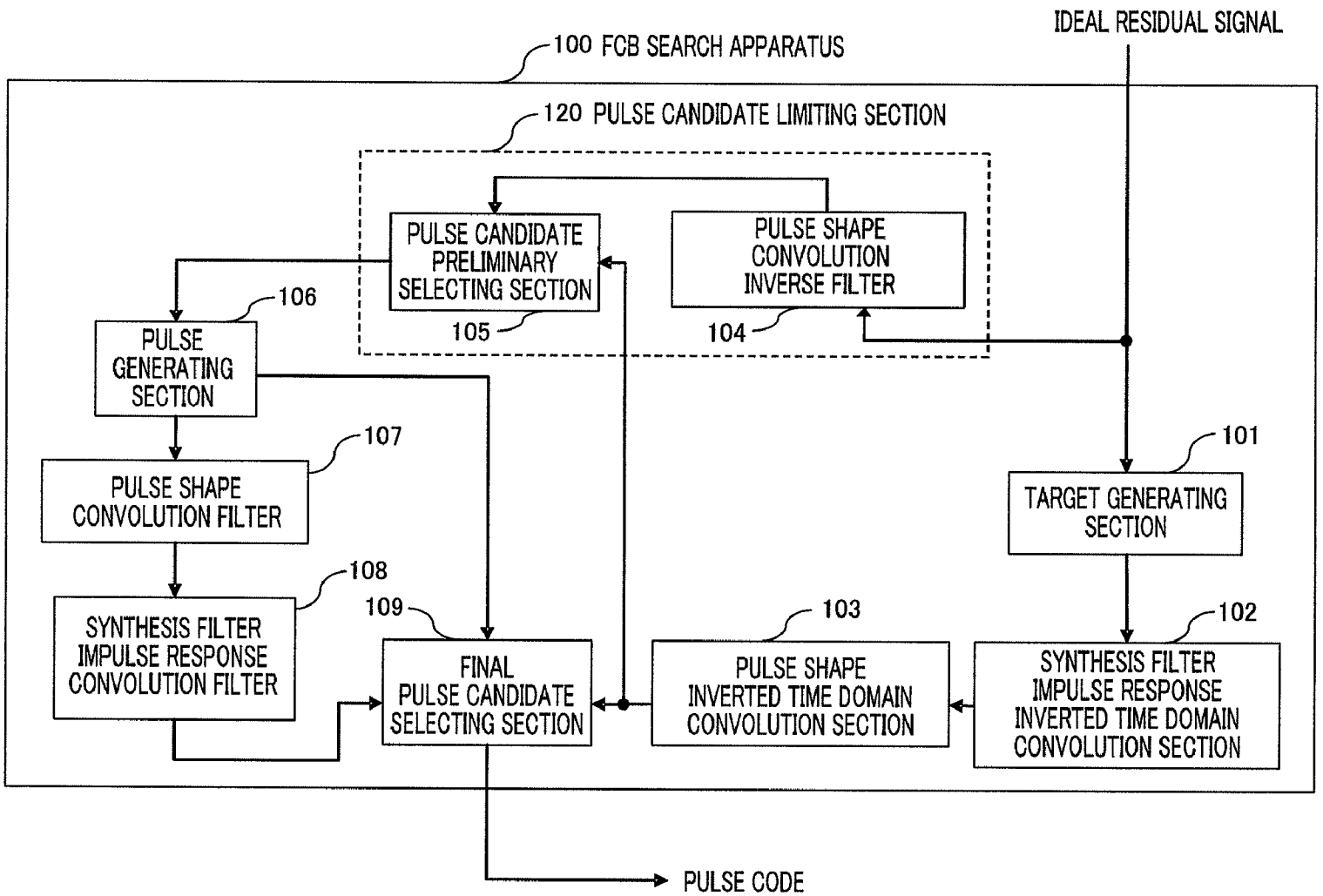
FIG. 3 is a block diagram showing main components of a fixed codebook search apparatus according to Embodiment 1.

FIG. 3 is a block diagram showing main components of fixed codebook search apparatus 100 according to the present embodiment. Fixed codebook search apparatus 100 reduces the number of the above pulse position candidates and makes a pulse search faster.

Fixed codebook (FCB) search apparatus 100 of the present embodiment employs a configuration having target generating section 101, synthesis filter impulse response inverted time domain convolution section 102, pulse shape inverted time domain convolution section 103, pulse shape convolution inverse filter 104, pulse candidate preliminary selecting section 105, pulse generating section 106, pulse shape convolution filter 107, synthesis filter impulse response convolution filter 108 and final pulse candidate selecting section 109. Here, for ease of expression, a perceptually weighted synthesis filter is simply referred to as "a synthesis filter."

An ideal residual signal to be inputted to FCB search apparatus 100 is inputted to target generating section 101 and pulse shape convolution inverse filter 104. Here, the ideal residual signal means a linear predictive residual signal, or a signal which is capable of achieving no quantization error if the signal can be generated using the fixed codebook.

Target generating section 101 corresponds to filter H shown in FIG. 2, and generates a target vector by convoluting the ideal residual signal with impulse response from a synthesis filter and outputs the target vector to synthesis filter impulse response inverted time domain convolution section 102. Here, the target vector corresponds to "x" shown in FIG. 2.

Synthesis filter impulse response inverted time domain convolution section 102 performs processing inverting and convoluting the synthesis filter impulse response in the time domain (calculation of "$x^tH$" in above equation 1) and outputs the acquired vector to pulse shape inverted time domain convolution section 103.

Pulse shape inverted time domain convolution section 103 performs processing inverting and convoluting the pulse shape in the time domain (corresponding to "$x^tHD$" in above equation 6), on the vector (corresponding to "$x^tH$" in above equations 1 and 6) acquired in synthesis filter impulse response inverted time domain convolution section 102, and outputs the vector acquired by this processing to pulse candidate preliminary selecting section 105 and final pulse candidate selecting section 109. Further, a combination of the processing in synthesis filter impulse response inverted time domain convolution section 102 and the processing in pulse shape inverted time domain convolution section 103 results in calculating above "$x^tHD$," so that it is possible to calculate "$x^tH$" in advance and multiply this by "D" or calculate "HD" in advance and multiply this by "$x^t$." The former corresponds to the processing described above using FIG. 3, while the latter corresponds to a case where synthesis filter impulse response inverted time domain convolution section 102 and pulse shape inverted time domain convolution section 103 are combined into the processing block that performs the following processing. That is, the processing block calculates a vector by convoluting the pulse shape with synthesis filter impulse response, performs processing of inverting in the time axis and of convoluting this vector with the target vector (the calculation of "$x^tHD$" described above), and outputs the result of these processing to pulse candidate preliminary selecting section 105 and pulse candidate definitive selecting section 109.

Pulse shape convolution inverse filter 104 outputs to pulse candidate preliminary selecting section 105, a signal acquired by passing the ideal residual signal through the inverse filter. Here, pulse shape convolution inverse filter 104 is the filter having inverse characteristic of pulse shape convolution filter 107 and corresponds to $D^{-1}$ shown in FIG. 2. Here, pulse shape convolution inverse filter 104 needs not to have the exact inverse characteristic, but it can have approximate opposite characteristic. The signal acquired by passing the ideal residual signal through the inverse filter corresponds to "z" shown in FIG. 2.

Pulse candidate preliminary selecting section 105 receives, as input, vector "z" outputted from pulse shape convolution inverse filter 104 and "$x^tHD$" outputted from pulse shape inverted time domain convolution section 103, decides pulses to be preliminary selected and outputs information related to this preliminary selection to pulse generating section 106.

Here, pulse candidate limiting section 120 is formed with pulse shape convolution inverse filter 104 and pulse candidate preliminary selecting section 105, and performs processing reducing the number of pulse position candidates using "z" and "$x^tHDc$." This processing corresponds to processing of preliminary selecting pulse position candidates using the minimization criteria for the error between "c" and "z" and the numerator term ($x^tHDc$) of the minimization criteria for the error between "x" and "HDc." Here, pulse shape convolution inverse filter 104 calculates "z" from the ideal residual signal and pulse shape inverted time domain convolution section 103 calculates "$x^tHDc$." For example, pulse candidate preliminary selecting section 105 selects pulse position candidates that give large values of the evaluation function defined by the linear summation of "z" and "$x^tHDc$."

Pulse generating section 106 generates a pulse vector comprised of limited combinations of pulses based on the information inputted from pulse candidate preliminary selecting section 105, outputs the generated vector to pulse shape convolution filter 107 and outputs information required to generate the outputted pulse vector, that is, outputs the position information and polarity information of each pulse to final pulse candidate selecting section 109.

Pulse shape convolution filter 107 is a filter that provides a shape vector to pulses of the pulse vector and is expressed by the following matrix of equation 7.

(Equation 7)

$$\begin{bmatrix} d_0^0 & 0 & \dots & 0 & 0 \\ d_1^0 & d_0^1 & \ddots & \vdots & \vdots \\ d_2^0 & d_1^1 & \ddots & 0 & 0 \\ \vdots & \vdots & \ddots & d_0^{n-2} & 0 \\ d_{n-1}^0 & d_{n-2}^1 & \dots & d_1^{n-2} & d_0^{n-1} \end{bmatrix} \begin{bmatrix} c_0 \\ c_1 \\ \vdots \\ c_{n-2} \\ c_{n-1} \end{bmatrix} \quad [4]$$

Here, vector $[d^i_k]_{i=0,\dots,n-1,\ k=0,\dots,n-1-i}$ (hereinafter simply "vector d") is a pulse shape vector to be convoluted with pulse position i, and vector $[c_K]_{k=0,\dots,N-1}$ is a pulse vector. Vector d may differ per pulse position i; however, there is a problem of having a memory for holding n types of vectors or increasing the amount of computation for calculating the correlation matrix of each vector. Accordingly, vector d that varies in all positions is not generally used.

Pulse shape convolution filter 107 convolutes the pulse shape by the pulse vector using above equation 7 and outputs the acquired vector to synthesis filter impulse response convolution filter 108.

Synthesis filter impulse response convolution filter 108 convolutes the vector outputted from pulse shape convolution filter 107 with an impulse response from the synthesis filter, and outputs the result to final pulse candidate selecting section 109.

Final pulse candidate selecting section 109 receives as input, the synthesized vector from synthesis filter impulse response convolution filter 108, vector "$x^tHD$" from pulse shape inverted time domain convolution section 103 and the pulse position information from pulse generating section 106, and calculates the value of the evaluation function expressed by following equation 6 explained above.

$$\text{Evaluation function} = x^tHDc/c^tD^tH^tHDc \quad \text{(Equation 6)}$$

Here, the synthesized vector inputted from synthesis filter impulse response convolution filter 108 corresponds to "HDc."

Precisely, the above evaluation function is expressed by following equation 8.

$$(x^tHDc)^2/(c^tD^tH^tHDc) \quad \text{(Equation 8)}$$

However, if the pulse polarity is limited in advance so as to make "$x^tHDc$" positive, the numerator term needs not be squared, and the combinations of polarities can be determined in advance, so that this method is employed to reduce the amount of computation.

Final pulse candidate selecting section 109 selects the pulse vector that maximizes the value of the evaluation function from all pulses generated in pulse generating section 106 and outputs pulse position information related to the pulse vector as pulse code information. Further, final pulse candidate selecting section 109 generally outputs not only pulse code information but also, for example, the finally selected pulse vector and the vector convoluting the pulse vector with synthesis filter impulse response. These outputted items are utilized to perform processing such as gain quantization stage and state update of the synthesis filter in a subsequent.

As described above, according to the present embodiment, an algebraic codebook search employing pulse dispersion is performed utilizing an evaluation function that minimizes the error between a signal acquired by passing an ideal residual signal through a pulse dispersion inverse filter and a pulse vector, that is, between a signal that becomes an ideal residual signal through a pulse dispersion filter and the pulse vector. To be more specific, a preliminary selection for codebook search is performed using a sum vector of a signal that becomes an ideal residual signal through a pulse dispersion filter and the numerator term of an evaluation function to be used for error minimization in general algebraic codebook search.

By this means, error minimization processing becomes simple and the amount of computation can be reduced, so that it is possible to suppress degradation of coding performance when fast fixed codebook search is performed.

Further, although an example has been described above with the present embodiment where a pulse shape vector is convoluted with a pulse vector and synthesis filter impulse response is further convoluted with the convoluted pulse vector, a configuration can be employed where an equivalent of matrix "HD" is calculated in advance by convoluting a pulse shape vector with synthesis filter impulse response in the same way as the numerator term. By this means, it is possible to calculate the denominator term easily. Generally, as disclosed in G.729 in ITU-T, an equivalent of matrix "$D^tHHD$" is calculated in advance and elements related to positions where pulses occur are extracted to calculate the denominator term.

Embodiment 2

Figure 4:
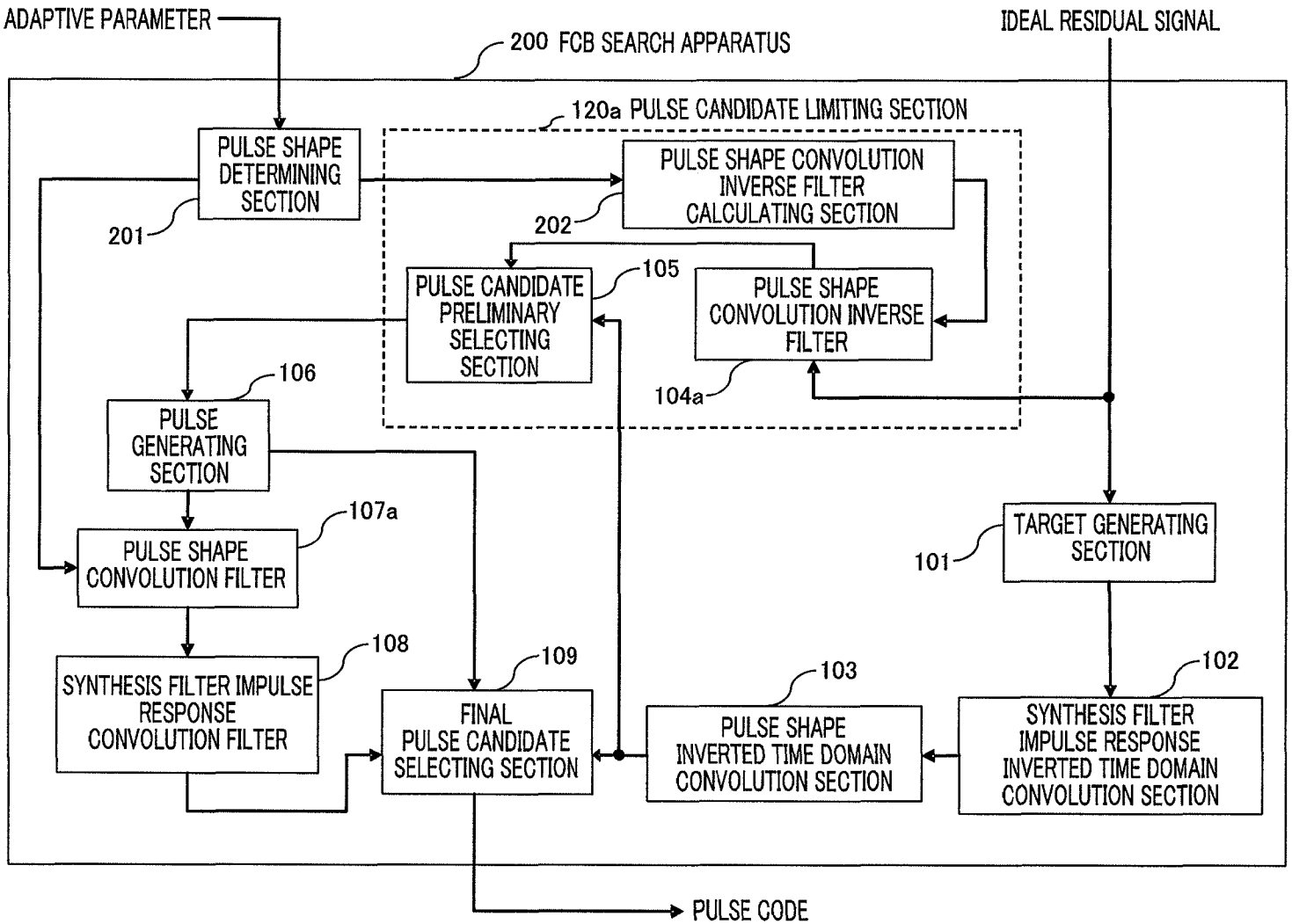
FIG. 4 is a block diagram showing main components of fixed codebook search apparatus according to Embodiment 2.

FIG. 4 is a block diagram showing main components of the fixed codebook search apparatus according to Embodiment 2 of the present invention. Here, this fixed codebook search apparatus has a similar basic configuration as the fixed codebook search apparatus described in Embodiment 1, and, consequently, the same components as in Embodiment 1 will be assigned the same reference numerals and detailed explanations thereof will be omitted. Further, the components having the same basic operation but having differences in their details will be assigned the same reference numerals with lower-case letters of alphabets for distinction, and will be explained properly.

Fixed codebook search apparatus 200 according to the present embodiment employs a configuration further having pulse shape determining section 201 and pulse shape convolution inverse filter calculating section 202 in addition to the configuration of Embodiment 1, and adaptively changes a pulse shape vector that is convoluted by a pulse shape filter.

To be more specific, pulse shape determining section 201 outputs the pulse shape vector changed according to adaptive parameters, to pulse shape convolution inverse filter calculating section 202. As a specific example of the adaptive parameters, there are parameters showing speech characteristics such as pitch gain, a flag showing mode information provided in advance and parameters showing the degree of noise characteristics.

A pulse shape changes adaptively, and, consequently, pulse shape convolution inverse filter calculating section 202 specifies the filter characteristic associated with each pulse shape for changing the inverse filter of the pulse shape convolution filter according to the change of the pulse shape.

To be more specific, pulse shape convolution inverse filter calculating section 202 performs the following operations.

For example, when adaptive processing for pulse shapes is a switching type, that is, when a pulse shape vector is adaptively selected from a plurality of types of pulse shape vectors prepared in advance, pulse shape convolution inverse filter calculating section 202 prepares in advance coefficients for the inverse filters associated with filters that convolute pulse shape vectors, and outputs the coefficients for the inverse filter associated with the selected pulse shape vector to pulse shape convolution inverse filter 104*a* using information on the pulse shape outputted from pulse shape determining section 201.

On the other hand, when adaptive processing for pulse shapes is a consecutive type, that is, when a pulse shape vector is expressed as a continuous function of adaptive parameters, pulse shape convolution inverse filter calculating section 202 directly calculates coefficients for the inverse filter based on the pulse shape vector outputted from pulse shape determining section 201 (calculates the inverse matrix of matrix D), or, by expressing in advance coefficients for pulse shape vector convolution inverse filter 104*a* as the function of adaptive parameters, calculates filter coefficients for pulse shape vector convolution inverse filter 104*a* using the function according to the adaptive parameters inputted from pulse shape determining section 201. This function may be approximated by a polynomial equation with an arbitrary order. The resulting filter coefficients for pulse shape convolution inverse filter 104*a* are outputted to pulse shape convolution inverse filter 104*a*.

As described above, the present embodiment employs a configuration selecting the inverse filter of a filter that convolutes pulse shape vectors, from filters prepared in advance based on adaptive parameters, or calculating the inverse filter using the function of the adaptive parameters, so that it is possible to yield the same effect as in Embodiment 1 using the inverse filter having appropriate characteristics as the inverse filter for the filter that convolutes the pulse shape vector even when a pulse shape vector that is convoluted by a pulse vector can be changed.

Embodiment 3

Embodiment 3 of the present invention shows an example where FCB search apparatus 100 shown in Embodiment 1 is provided with a CELP coding apparatus. Here, in the present embodiment, FCB search apparatus 100 will be referred to as "FCB search section 305."

Figure 5:
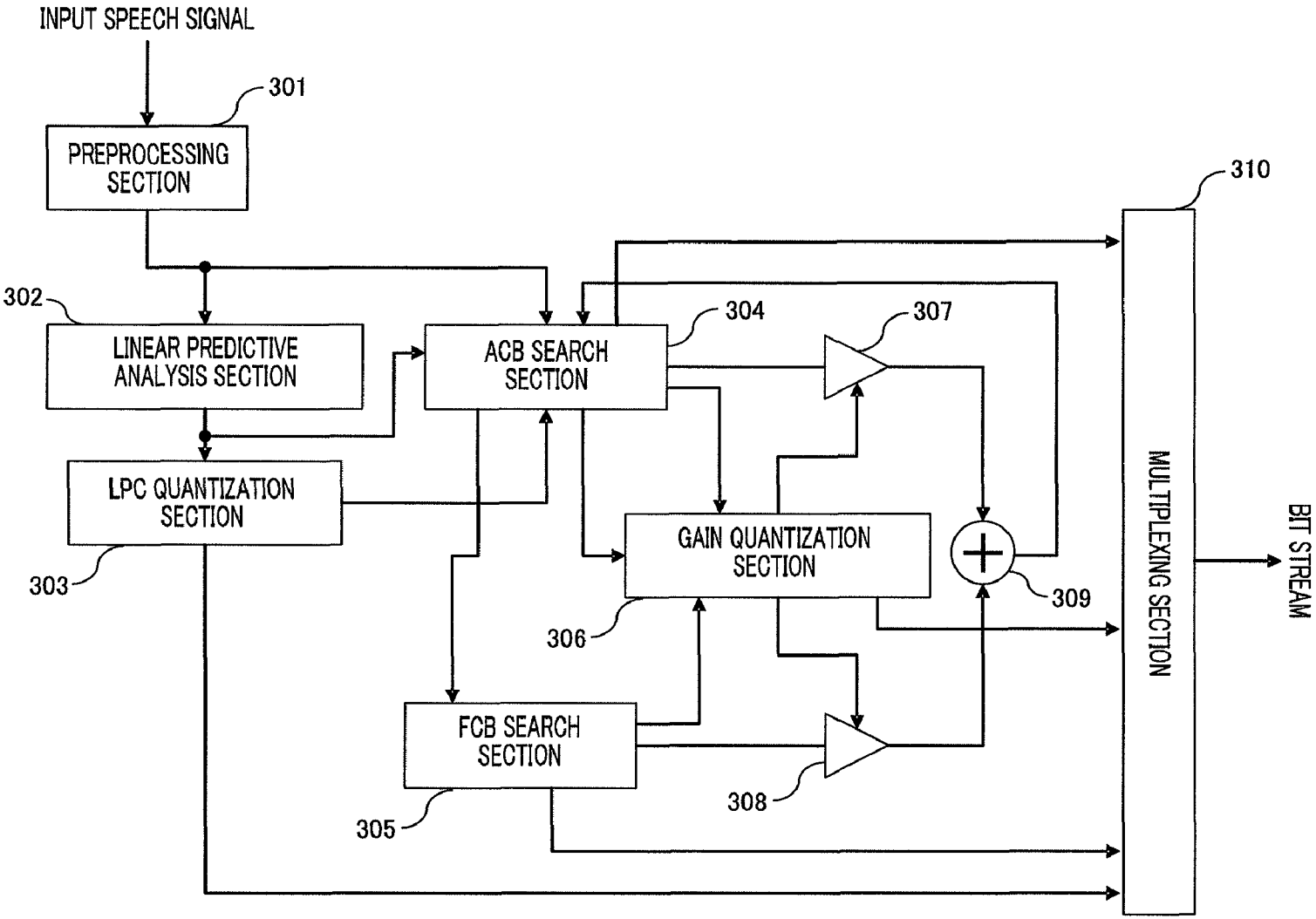
FIG. 5 is a block diagram showing main components of CELP coding apparatus according to Embodiment 3.

FIG. 5 is a block diagram showing main components of the CELP coding apparatus according to the present embodiment.

Sections of the CELP coding apparatus according to the present embodiment will operate as follows.

Preprocessing section 301 performs high-pass filter processing for eliminating direct current components or processing for improving coding performance of CELP coding such as pre-emphasis processing on an input speech signal and outputs the input speech signal after the preprocessing to linear predictive analysis section 302 and ACB search section 304.

Linear predictive analysis section 302 performs linear prediction for the inputted speech signal after the preprocessing and outputs the resulting linear prediction coefficient (LPC) to LPC quantization section 303 and ACB search section 304.

LPC quantization section 303 quantizes the inputted LPC and outputs the quantized LPC to ACB search section 304. Further, LPC quantization section 303 outputs coding information of the LPC (LPC code) to multiplexing section 310. Here, quantization of LPC is generally performed by converting the LPC into parameters such as LSF.

ACB search section 304 comprises functions of: generating a target vector; searching an adaptive codebook; calculating parameters required for a fixed codebook search; updating the adaptive codebook; and updating filter condition.

Here, the target vector is acquired by calculating a perceptually weighted input speech signal from which zero input response components of a synthesis filter are subtracted. The perceptually weighting filter is a pole-zero filter or all-pole filter using a result calculated by multiplying a weighting coefficient by the LPC inputted from linear prediction analyzing section 302. The target vector is used for the adaptive codebook search explained below and outputted to gain quantization section 306.

Further, ACB search section 304 performs an adaptive codebook search using an adaptive codebook that buffers past quantized excitation signals inputted from adder 309, impulse response from the synthesis filter calculated by the quantized LPC inputted from LPC quantization section 303, and the target vector. To be more specific, an extracting position of the adaptive codebook is determined so that the error between the target vector and the result of multiplication of the optimum gain with a result of convolution of the impulse response of the synthesis filter with an adaptive codebook excitation vector extracted from the adaptive codebook is minimized. Parameters showing this position are inputted to multiplexing section 310 as adaptive codebook coded information. Further, a result of the convolution of the impulse response of the synthesis filter with the adaptive codebook excitation vector extracted and generated from the extracting position determined, is used for gain quantization, and, consequently, outputted to gain quantization section 306. Further, the adaptive codebook excitation vector extracted and generated from the extracting position determined is outputted to amplifier 307.

As parameters, those are required for the fixed codebook search, a signal acquired by eliminating adaptive codebook components (acquired by multiplying the ideal gain by the generated adaptive codebook excitation vector) from the linear prediction residual signal of the preprocessed input speech signal, is calculated and outputted to FCB search section 305. Here, ideal gain $g_a$ of the adaptive codebook excitation vector is calculated by following equation 9.

(Equation 9)

$$g_a = \frac{x^t Ha}{a^t H^t Ha} \quad [5]$$

However, if $g_a$ is out of the range where $g_a$ can be quantized, e.g., in a case where $g_a$ is a negative value or much greater than 1.0 (in the case of onset part, $g_a$ typically becomes equal to or greater than the value of 2.0), gain quantization section 306 sets a lower limit or an upper limit on the range where $g_a$ can be quantized. Here, "x" is a target vector, "H" is a perceptually weighted impulse response convolution matrix and "a" is an adaptive codebook excitation vector.

Updating the adaptive codebook and updating the condition of the synthesis filter are performed after both the processing of the fixed codebook search and the processing of the gain quantization, which will be described later, have been completed and a quantization excitation signal have been generated.

The adaptive codebook is updated using the quantized excitation signal inputted from adder 309. That is, the buffer of the adaptive codebook is shifted by the samples of unit time for coding and stores the latest quantized excitation signal in the available buffer.

Further, the synthesis filter is driven using the quantized excitation signal to update the condition of the synthesis filter and updates the condition of the auditory weighting filter. These updates for filter condition are generally performed in CELP coding and performed in the method specified by various standard codecs such as ITU-T Recommendation G.729.

FCB search section 305 receives as input, the ideal residual signal as the fixed search codebook component from ACB search section 304. As described in Embodiment 1, FCB search section 305 operates to output a pulse code to multiplexing section 310, output the selected pulse vector to amplifier 308 and output a result yielded by convoluting perceptually weighted impulse response by the pulse vector to gain quantization section 306. Here, for example, a pitch filter may be applied to the pulse vector. As an example of the pitch filter, there is a pitch prefilter used in ITU-T Recommendation G.729.

Gain quantization section 306 receives as input, the adaptive codebook excitation vector acquired by convoluting the synthesis filter impulse response with the target vector from ACB search section 304 and the result acquired by convoluting the synthesis filter impulse response with the pulse vector from FCB search section 305, determines $g_a$ and $g_f$ that minimize following equation 10 and outputs them to corresponding amplifiers 307 and 308, respectively.

$$|x-(g'_a Ha+g'_f Hc)|^2 \quad \text{(Equation 10)}$$

Here, "x" is the target vector, "H" is the synthesis filter impulse response convolution matrix, "a" is an adaptive codebook excitation vector, "c" is a pulse vector (fixed codebook excitation vector), "$g_a$'" is a quantized adaptive codebook gain and "$g_f$'" is a quantized fixed codebook gain.

Amplifier 307 receives as input, the adaptive codebook excitation vector from ACB search section 304, multiplies $g_a$' by the vector and outputs the result to adder 309.

Amplifier 308 receives as input, the pulse excitation vector (fixed codebook excitation vector) from FCB search section 305, multiplies $g_f$' by the vector and outputs the result to adder 309.

Adder 309 adds the vectors inputted from two amplifiers 307 and 308, and outputs the result to ACB search section 304.

Multiplexing section 310 receives as input, the adaptive codebook code from ACB search section 304, the pulse code (fixed codebook code) from FCB search section 305, the gain code from gain quantization section 306 and the LPC code from LPC quantization section 303, multiplexes these items and outputs the result as bit streams.

As described above, according to the present embodiment, it is possible to apply the fixed codebook search apparatus to CELP coding.

Embodiments of the present invention have been explained above.

The fixed codebook search apparatus and fixed codebook search method according to the present invention are not limited to above-described embodiments and can be implemented in several variations.

The fixed codebook search apparatus according to the present invention can be mounted on a communication terminal apparatus and base station apparatus in the mobile communication system, so that it is possible to provide a communication terminal apparatus, base station apparatus and mobile communication system having the same operational effect as above.

Although a case has been described with the above embodiments as an example where the present invention is implemented with hardware, the present invention can be implemented with software. For example, by describing the fixed codebook search method according to the present invention in a programming language, storing this program in a memory and making the information processing section execute this program, it is possible to implement the same function as the fixed codebook search apparatus of the present invention.

Furthermore, each function block employed in the description of each of the aforementioned embodiments may typically be implemented as an LSI constituted by an integrated circuit. These may be individual chips or partially or totally contained on a single chip.

"LSI" is adopted here but this may also be referred to as "IC," "system LSI," "super LSI," or "ultra LSI" depending on differing extents of integration.

Further, the method of circuit integration is not limited to LSI's, and implementation using dedicated circuitry or general purpose processors is also possible. After LSI manufacture, utilization of an FPGA (Field Programmable Gate Array) or a reconfigurable processor where connections and settings of circuit cells in an LSI can be reconfigured is also possible.

Further, if integrated circuit technology comes out to replace LSI's as a result of the advancement of semiconductor technology or a derivative other technology, it is naturally also possible to carry out function block integration using this technology. Application of biotechnology is also possible.

The present application is based on Japanese Patent Application No. 2005-356634, filed on Dec. 9, 2005, the disclosure of the description, drawings and abstract of which are expressly incorporated by reference herein.

INDUSTRIAL APPLICABILITY

The fixed codebook search apparatus and fixed codebook search method according to the present invention are applicable to, for example, a communication terminal apparatus and base station apparatus in the mobile communication system.

The invention claimed is:

1. A fixed codebook search method for searching a fixed codebook that generates a fixed codebook vector by convolving a shape vector with a pulse, comprising:

filtering a linear prediction residual signal using a filter having opposite characteristics with respect to a pulse dispersion filter that convolves the shape vector;

limiting pulse position candidates in a pulse vector using a first evaluation function that minimizes an error between a signal acquired by filtering using the filter having the opposite characteristics and the pulse vector; and searching the fixed codebook using the limited pulse position candidates and a second evaluation function.

2. The fixed codebook search method according to claim 1, wherein the second evaluation function comprises a value calculated by normalizing a cross-correlation between a target vector and a synthesized signal using energy of the synthesized signal.

3. The fixed codebook search method according to claim 1, wherein a following equation is used as the second evaluation function:

$$\text{second evaluation function} = x^t HDc / (c^t D^t H^t HDc)$$

where x: target vector;

H: lower triangular matrix expressing impulse response convolution in an auditory weighting synthesis filter;

D: convolution matrix for a dispersion vector;

c: pulse vector; and t: subscript expressing a transposed matrix or a transposed vector.

4. A fixed codebook search apparatus that searches a fixed codebook that generates a fixed codebook vector by convolving a pulse with a shape vector, the fixed codebook search apparatus comprising:

an inverse filter including a processor that has opposite characteristics with respect to a pulse dispersion filter that convolves the shape vector and filters a linear prediction residual signal;

a first selector that minimizes an error between a signal acquired by filtering using the inverse filter and a pulse vector, and selects a plurality of pulse position candidates for the pulse vector; and a second selector that minimizes an error between a target signal and an auditory weighting synthesized signal using a second evaluation function, and selects a set of pulse positions from the plurality of pulse position candidates.

5. The fixed codebook search apparatus according to claim 4, further comprising:

a determiner that determines the shape vector based on adaptive parameters; and a calculator that calculates opposite characteristics with respect to the filter that convolves the shape vector, wherein the inverse filter performs filtering using the opposite characteristics calculated in the calculator.

6. A communication terminal apparatus comprising the fixed codebook search apparatus according to claim 4.

7. A base station apparatus comprising the fixed codebook search apparatus according to claim 4.

* * * * *